US006672783B1

(12) United States Patent
Licata et al.

(10) Patent No.: US 6,672,783 B1
(45) Date of Patent: Jan. 6, 2004

(54) FILL, REFILL DISPOSABLE TOOTHBRUSH PACKAGE

(76) Inventors: Kenneth Rocco Licata, 10 S. Vrain St., Denver, CO (US) 80219; Cheryl Lynn Licata, 10 S. Vrain St., Denver, CO (US) 80219

( * ) Notice: Subject to any disclaimer, the term of this patent is extended or adjusted under 35 U.S.C. 154(b) by 0 days.

(21) Appl. No.: 10/230,451

(22) Filed: Aug. 30, 2002

(51) Int. Cl.[7] ..... A46B 11/00

(52) U.S. Cl. ..... 401/123; 401/184; 401/268; 401/118; 132/309

(58) Field of Search ..... 401/195, 183, 401/184, 185, 268, 269, 118, 119; 15/105, 106, 167.1, 110; 132/308, 309, 311

(56) References Cited

U.S. PATENT DOCUMENTS

| | | | | | |
|---|---|---|---|---|---|
| 4,887,621 | A | * | 12/1989 | Vallieres | 132/309 |
| 4,957,125 | A | * | 9/1990 | Yaneza | 132/309 |
| 5,599,126 | A | * | 2/1997 | Hough | 401/184 |
| 5,950,641 | A | * | 9/1999 | Taveras | 132/309 |
| 6,325,076 | B1 | * | 12/2001 | Ramirez | 132/309 |

* cited by examiner

*Primary Examiner*—David J. Walczak

(57) ABSTRACT

A fill and refill disposable toothbrush package comprising of a neck having tufts attached thereon at one end at the traditional location where the head placement on a conventional toothbrush, at the opposite end a hollowed opening that can be integrated therewith a fill handle. The fill handle having a cylindrical open center within and throughout for storage of toothpaste. The fill handle at one end able to integrate therewith the neck. At the opposite end of fill handle which can be integrated therewith an end plug. Thereon end plug dental floss within an annular groove and floss cutter. A refill handle that is an exact duplication of fill handle, at one end a front closing cap that can be integrated therewith the refill handle, at the other end a rear closing cap that is integrated thereon to the refill handle. The fill handle and refill handle having a soft elastical non-porous membrane intermediate thereon extending over to enclose an open cavity having concave sides. The fill handle and refill handle having capabilities of having toothpaste dispensed into the fill, refill handles from an available soft commercial tube of toothpaste and which is not limited to dispensing toothpaste when there is a downward force on the soft elastical non-porous membrane of the fill or refill handle. The fill, refill disposable toothbrush package includes within components having complementarity [[threads]] attachable releasable means that can be integrated therewith other components in the toothbrush package.

1 Claim, 7 Drawing Sheets

FILL, REFILL DISPOSABLE TOOTHBRUSH PACKAGE

CROSS-REFERENCE TO RELATED APPLICATIONS

CROSS-REFERENCE TO RELATED APPLICATIONS

| | | | |
|---|---|---|---|
| 4,291,995 | September 29, 1981 | Dikoff | 401/175 |
| 4,655,627 | April 7, 1987 | Bradey | 401/171 |
| 5,123,765 | June 23, 1992 | O'Connel, et al. | 401/126 |
| 6,213,662 | April 10, 2001 | Aljanedi | 401/175 |
| 6,244,777 | June 12, 2001 | Reid | 401/269 |
| 6,257,791 | July 10, 2001 | Scamard | 401/286 |
| 6,273,629 | August 14, 2001 | Jordan | 401/286 |
| 6,325,076 | December 4, 2001 | Ramirez | 132/309 |
| 6,334,451 | January 1, 2002 | Yang | 132/311 |
| 6,345,629 | February 12, 2002 | Vives | 132/308 |
| 6,386,779 | May 14, 2002 | Davis | 401/175 |
| 6,390,103 | May 21, 2002 | Manso | 132/309 |

STATEMENT OF FEDERALLY SPONSORED RESEARCH OR DEVELOPMENT

Not Applicable

REFERENCE TO A MICROFICHE APPENDIX

Not Applicable

BACKGROUND OF THE INVENTION

This present invention relates to dental hygienics. The present invention is a fill, refill disposable toothbrush package with capabilities of dispensing toothpaste with refill capabilities and is disposable.

There is a need for a convenient, useful and practical way to acquire dental hygiene. It is impractical carrying a toiletry case or carrying a toothbrush and toothpaste to events or an apparatus that is larger than a toothbrush which may be at times cumbersome in our fast-paced society. That is why there is a need of a toothbrush package all in one. To expand upon an old cliche, "an ounce of prevention is worth a pound of cure." It is proven that by taking the proper measures in dental hygienics, many problems of oral hygiene will be prevented. The present invention will encourage dental hygiene plus to utilize the conventional toothbrush and toothpaste.

The present invention, the fill, refill disposable toothbrush package, can be stored in the same manner as a normal toothbrush in a glove compartment, backpack, purse, fanny pack, school lunch box and the like.

The present invention can include but are not limited to vacations, outings, rest areas, truck stops; used by campers, hikers, overnight trips by business personnel, emergencies to hospitals, overnight stays at hospitals, given out as samples at Dental Facilities, be used as promotions or given as complimentary gifts at hospitals, hotels, motels—as a novelty though still useful in its own degree such as disposable razors and ink pens and the like.

With respect to the prior arts, several solutions for a toothbrush with toothpaste and refilling means have been proposed. These devices fulfill their respective, particular object and requirement in their scope of concepts and designs. The proposed solutions have had disadvantages of being cumbersome, impractical, ineffective, complicated, expensive to produce.

U.S. Pat. No. 6,386,779; U.S. Pat. No. 6,334,451; U.S. Pat. No. 6,345,629 in essence have taken away the simplicity of the toothbrush and have mechanized the toothbrush.

U.S. Pat. No. 6,402,410 discloses a power toothbrush which, in general, has mechanisms to operate the toothbrush.

U.S. Pat. No. 6,325,076 discloses a reservoir for toothpaste—a sack having a dispensing means for applying pressure to toothpaste.

U.S. Pat. No. 6,273,629 discloses a dispensing toothbrush with a mechanism adapted for forcing toothpaste to the bristles in the toothbrush which strays from the simplicity and practicality of a toothbrush.

U.S. Pat. No. 4,662,984 disclosed a toothbrush and toothpaste dispenser comprised of a hand manipulated rotating shaft with a transparent indicator window.

In general, the prior arts have been difficult to operate, unreliable and costly to manufacture. Reasons for failure—clogging of the fluid lines or exit opening, malfunctioning pumps, complex systems, forcing paste through a small orifice, large to maintain their strength and cumbersome.

BRIEF SUMMARY OF THE INVENTION

Therefore, a primary object of the present invention is the provision of a new and improved toothbrush to deviate from the conventional concepts to a simplified toothbrush which can be mass produced inexpensively with filling of toothpaste, refills, and disposable capabilities.

Another object of the present invention is that the refill handle and fill handle having internal threads that would be complementarity to the circumference of a commercial toothpaste tube's external threads, so that an user would be able to dispense toothpaste into the fill or refill handle for one or several uses, which is separate from the head containing tufts—which has advantages over the prior art.

A further object of the present invention is that it would be easily used by children to adults alike.

A further object of the present invention is that it has six (6) separate components which are complementarity to one another.

A further object of the present invention is that the fill and refill handle can be refilled simply and tidy—which has an advantage over the prior art.

A further object of the present invention is it may be easily and efficiently manufactured from materials and techniques in the manner known to the art, without the mechanisms of the afore mentioned prior art, easily packaged as now is readily toothbrushes. The package could be marketed with or without toothpaste in the handle showing preference to the consumer.

Lastly, a further object of the present invention is that it can be incorporated into expected and obvious structural configurations of toothbrush designs.

These and other objects of the present invention will become apparent to those skilled in the art as the description thereof proceeds.

DETAILED DESCRIPTION OF THE INVENTION

Figure 1:
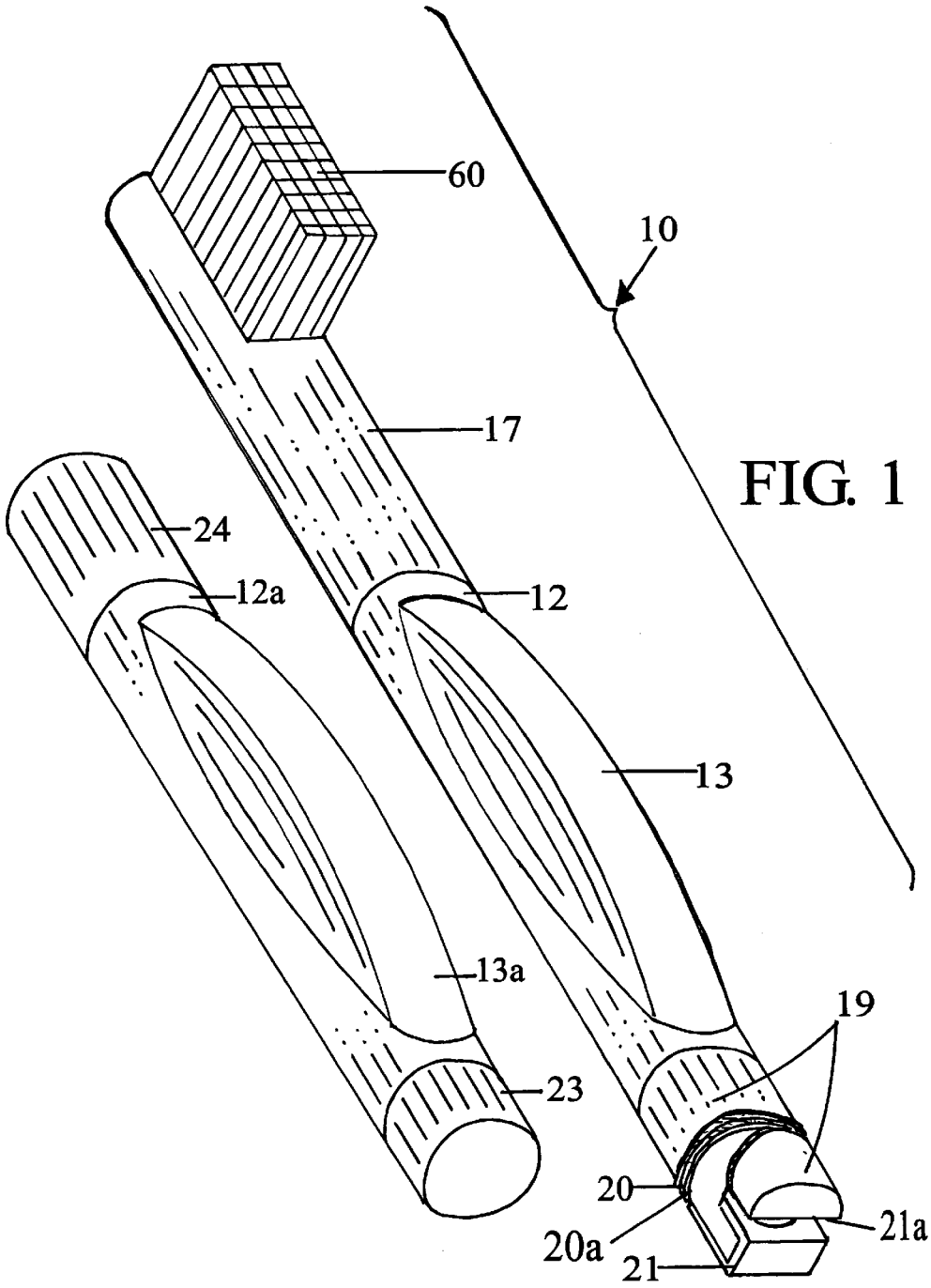
FIG. 1 is a perspective view of the present invention showing the components joined in a manner securely fixed.

Referring to FIG. 1 there is shown the preferred embodiments of the fill, refill disposable toothbrush package of the present invention. The numeral 10 designates the fill, refill disposable toothbrush package. The fill, refill disposable package 10 comprises a neck 17 having distal ends, attached thereon tufts 60 at the outward proximal end. The inward end of neck 17 having attachable releasable means with fill handle 12, fill handle 12 having distal ends, on one end capabilities for dispensing toothpaste (not shown) and on the opposite end, filling capabilities (not shown) which will be described further on. Fill handle 12 having a soft elastical non-porous membrane 13 of chemical and material composition properties known to the art which is generally similar to the composition or the same composition of a soft commercial toothpaste tube or a soft rubber balloon-like material intermediate attached thereon fill handle 12. An end plug 19 having distal ends, the inward end of end plug 19 having attachable releasable means with fill handle 12. End plug 19 having a floss cutter 21 secured in groove 21*a* at the outward end of end plug 19 with dental floss 20 attached and wound around an intermediate annular groove 20*a*. A refill handle 12*a* having distal ends which has the capabilities on one end for dispensing toothpaste (not shown) and on the opposite end, filling capabilities (not shown) which will be described further on. Refill handle 12*a* having a soft elastical non-porous membrane 13*a* of chemical and material composition and properties known to the art which is generally similar to the composition or the same composition of a soft commercial tube, or a soft rubber balloon-like material intermediate attached thereon refill handle 12*a*. A front closing cap 23 having distal ends and a rear closing cap 24 having distal ends, at the inward ends attachable releasable means with refill handle 12*a*. The configuration of neck 17 is used only for descriptive purposes herein. The configuration of neck 17 can vary and maybe oval, square, rectangle or other desired configuration. The configuration of fill handle 12 and refill handle 12*a* are used only for descriptive purposes herein and would be complementary to the configuration of neck 17 when integrated as a complete toothbrush.

Figure 2:
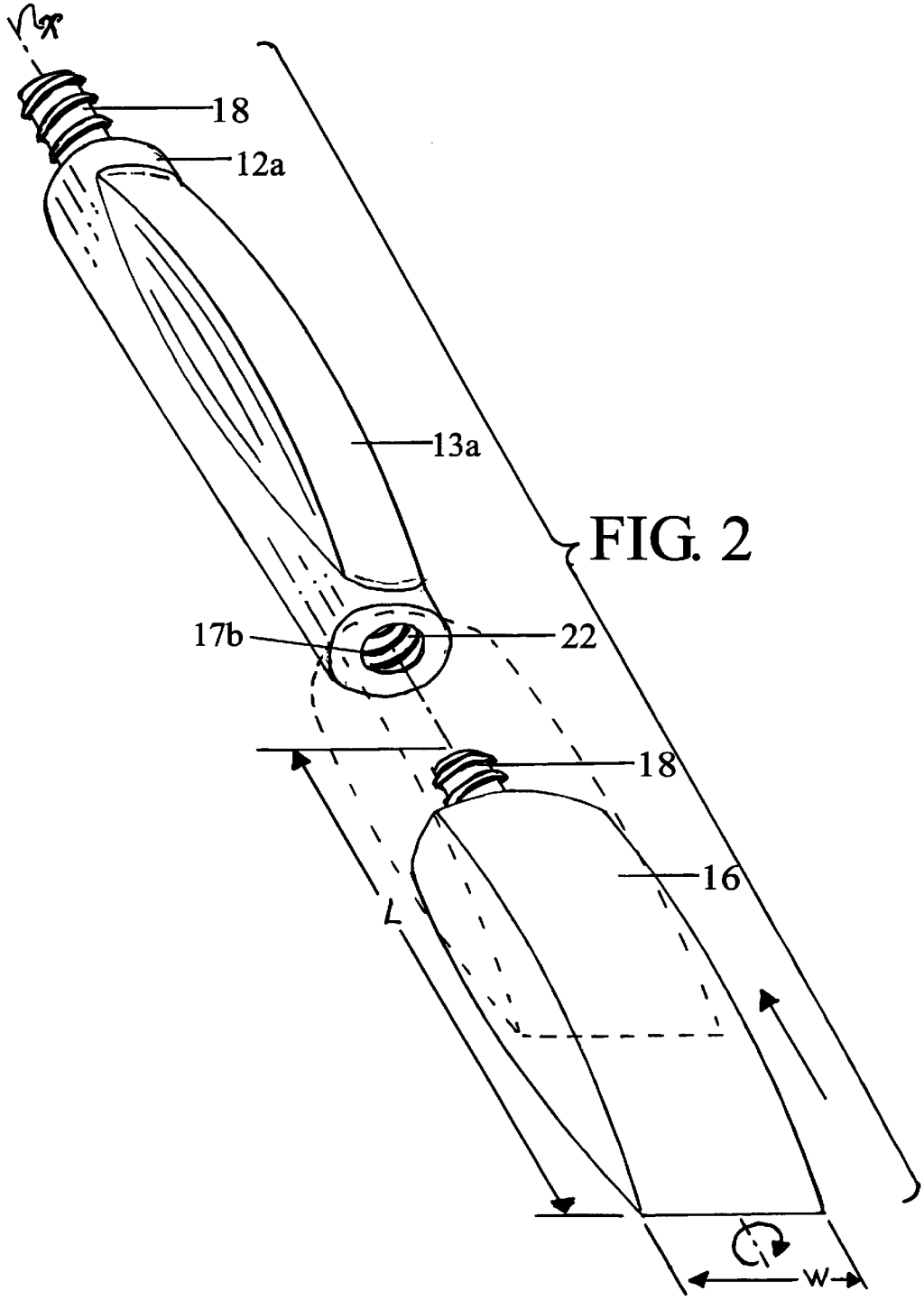
FIG. 2 is a perspective view showing the process of joining a commercial tube of toothpaste axially to the refill handle of the present invention at the longitude axial.

Referring to FIG. 2 illustrates the coupling procedure for the filling process of toothpaste. FIGS. 3, 4, 7, 8 are used to identify components. In FIGS. 2–12 several attachable releasable means are known to the art. The usage of terms external threads 18 and internal threads 22 are for descriptive and clarification purposes. The components may be equipped with different attachable releasable means which would not depart from the spirit or scope of the present invention. Referring to FIG. 2 the refill handle 12*a* having distal ends, at one end plurality of external threads 18 having an opening (not shown) for dispensing toothpaste and releasing pressure. At the opposite end of refill handle 12*a* an axial (x) bore 17*b* having plurality of internal surface threads 22. The process of filling the refill handle 12*a* with an available soft commercial toothpaste tube 16 having a plurality of external threads 18 with an opening for dispensing toothpaste, at the end of the refill handle 12*a* an axial (x) bore 17*b* having plurality of internal surface threads 22. The external threads 18 of the toothpaste tube 16 complementarity integrates with the plurality of internal surface threads 22 of refill handle 12*a* axially (x) via circular rotation of the toothpaste tube 16 until securely joined. The toothpaste tube 16 is then prepared to dispense toothpaste into the bore 17*b* within and throughout the refill handle 12*a*. Therein would be an expansion of the elastical non-porous membrane 13*a* as refill handle 12*a* receives the toothpaste (not shown), at the opposite end of refill handle 12*a* having external threads would release pressure through the opening (not shown) for dispensing toothpaste. Furthermore fill handle 12 would also be filled by the same procedure set forth and will become evident further on in the description.

Figure 3:
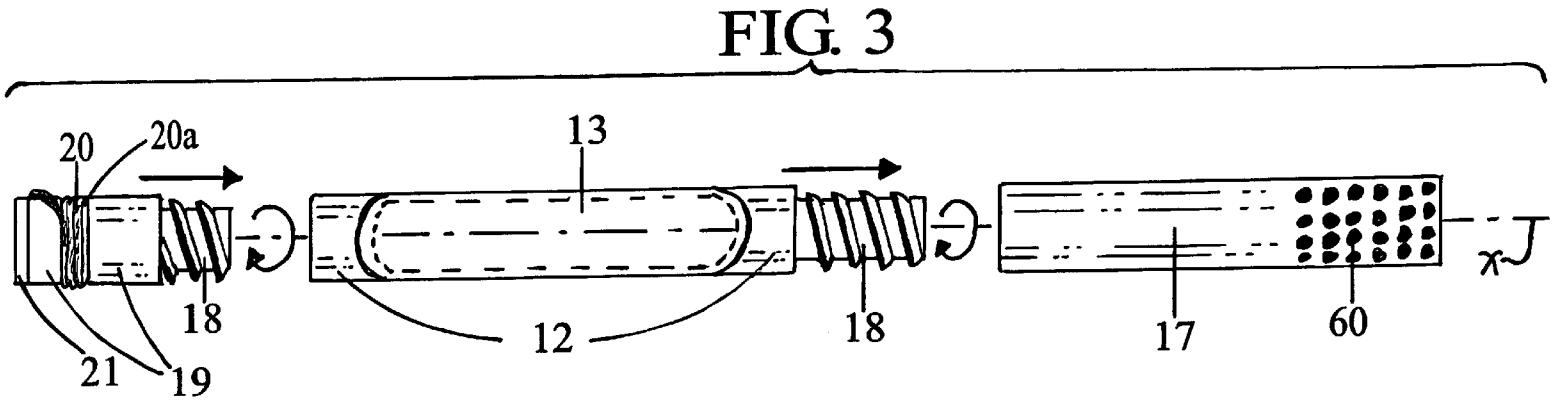
FIG. 3 is a frontal view of the present invention showing the toothbrush embodiment components disassembled at the longitude axial.
Figure 4:
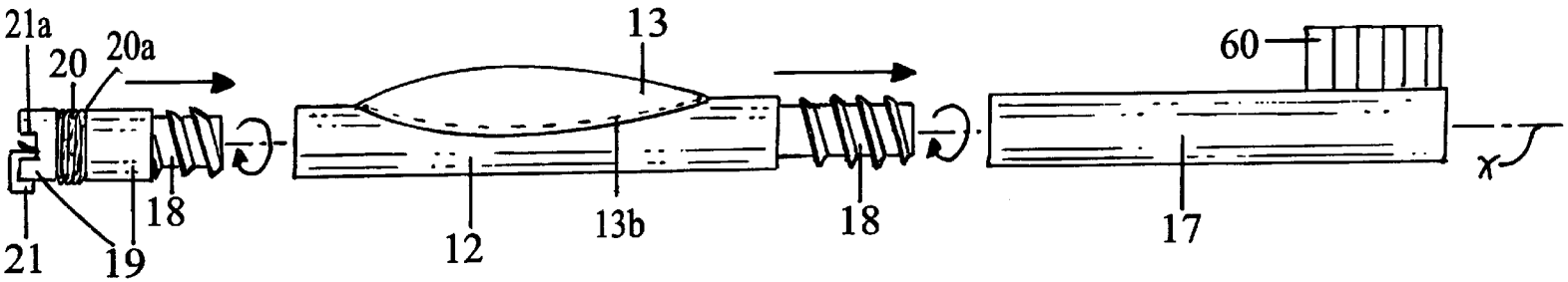
FIG. 4 is a side view of the present invention showing the toothbrush embodiment components disassembled at the longitude axial.
Figure 5:
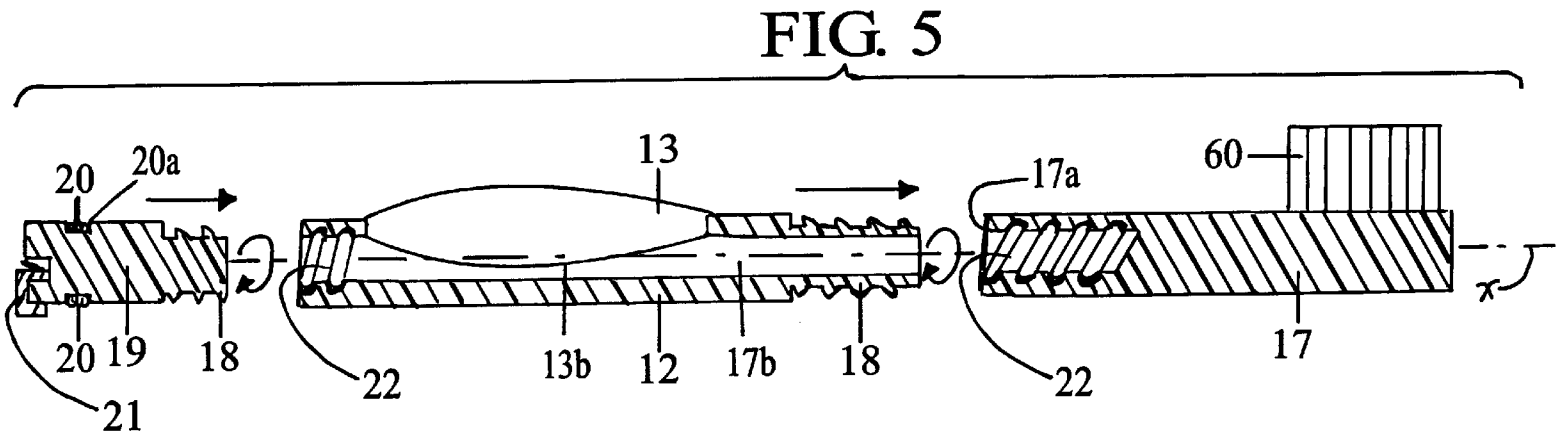
FIG. 5 is a cross sectional side view of the present invention showing the toothbrush embodiment components disassembled at the longitude axial.

Referring to FIGS. 3, 4, 5 illustrates components of the preferred embodiment fill handle 12 and the procedure for integration. Neck 17 having distal ends, thereon tufts 60 at the outward proximal end securely affixed in or attached to neck 17 in manner known to the art. At the inward end of the solid neck 17 an inner hollowed opening 17*a* axially (x), within inner hollowed opening 17*a* plurality of internal surface threads 22. Fill handle 12 having an open bore 17*b* axially (x) for storage of toothpaste within and throughout. Fill handle 12 having distal ends at one end having plurality of internal surface threads 22 within the open bore 17*b* (which also can complementarity integrate with an available soft commercial tube of toothpaste not shown), at the opposite end of fill handle 12 the open bore 17*b* for dispensing toothpaste having plurality of external threads 18, a soft elastical non-porous membrane 13 attached fixedly to fill handle 12 via a bonding agent or bonding technique in manners known to the art relating to the composition of material of fill handle 12 and membrane 13 thereon covering an open depressed section 13*b* lengthwise. End plug 19 being solid having distal ends at the outward end having a floss cutter 21 fixedly secured in groove 21*a*. At the inward end of end plug 19 having plurality of external threads 18 axially (x) complementarity to attach or release from fill handle 12 end opening having plurality of internal surface threads 22 integrating via circular rotating end plug 19 or fill handle 12 until securely joined. End plug 19 having dental floss 20 attached and wound around an intermediate annular groove 20*a*. Fill handle 12 having distal ends, at one end plurality of internal surface threads 22 to attach or release from end plug 19 having plurality of external threads 18. At the opposite end of fill handle 12 plurality of external threads 18 complementarity to attach or release from neck 17 inner hollowed opening 17*a* having plurality of internal surface threads 22 integrating via circular rotating fill handle 12 or neck 17 until securely joined. Disassembling of components are the reversed procedure of the integration of components described therein.

Figure 6:
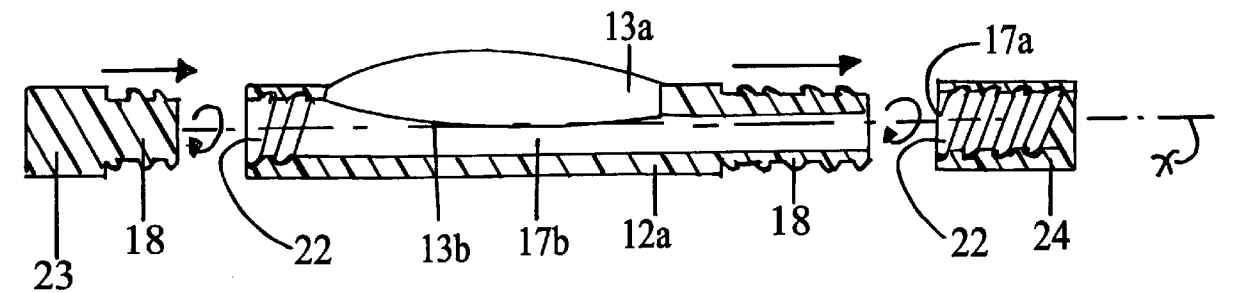
FIG. 6 is a cross sectional side view of the present invention's toothbrush refill handle embodiment showing the components disassembled at the longitude axial.
Figure 7:
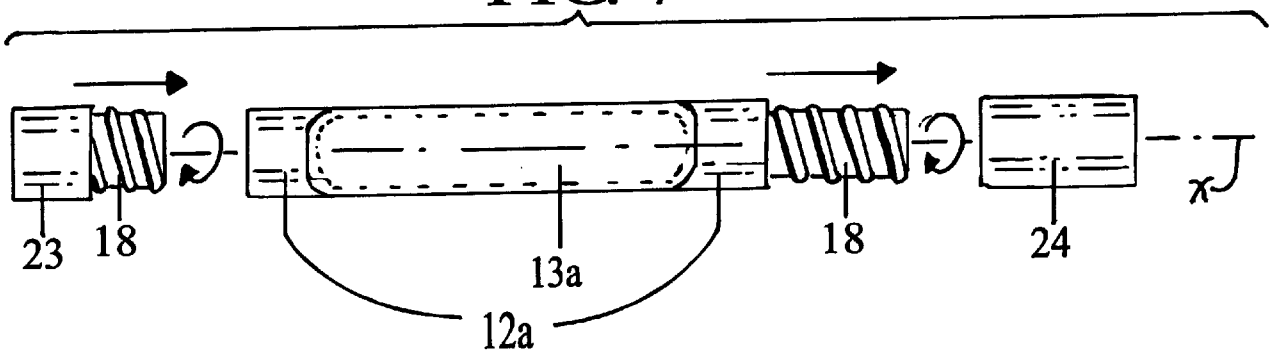
FIG. 7 is a frontal view of the present invention's toothbrush refill handle embodiment showing the components disassembled at the longitude axial.
Figure 8:
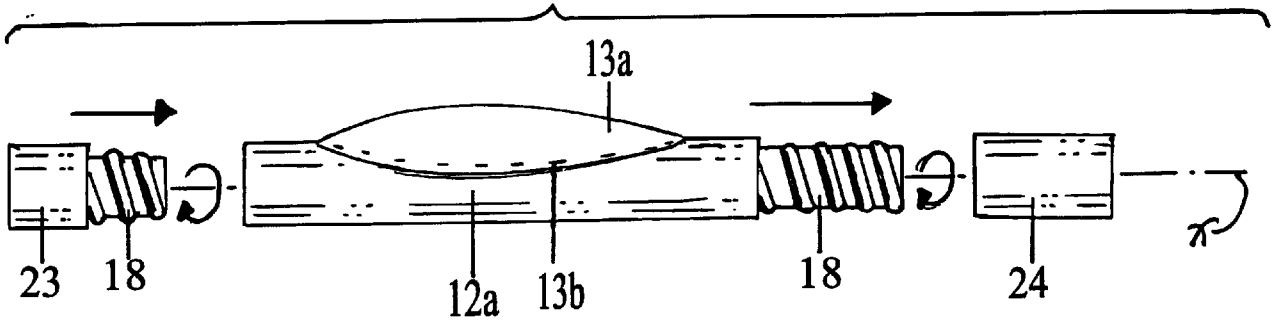
FIG. 8 is a side view of the present invention's toothbrush refill handle embodiment showing the components disassembled at the longitude axial.

Referring to FIGS. 6, 7, 8 illustrates components of the preferred embodiment refill handle 12*a* and the procedure for integration, front closing cap 23 being solid having distal ends, at the inward end plurality of external threads 18, a refill handle 12*a* having an open bore 17*b* axially (x) for storage of toothpaste within and throughout. Refill handle 12*a* having distal ends, at one end plurality of internal surface threads 22 within the open bore 17*b* axially (x) (which also can complementarity integrate with an available soft commercial tube of toothpaste not shown), at the opposite end of refill handle 12*a* the open bore 17*b* for dispensing toothpaste having plurality of external threads 18, a soft elastical non-porous membrane 13*a* covering an open depressed section 13*b* attached fixedly to refill handle 12*a* via a bonding agent or bonding technique in manners known to the art relating to the composition of material of refill handle 12*a* and membrane 13*a* thereon covering an open depressed section 13*b* lengthwise. A rear closing cap 24 having distal ends, at the inward end within the rear closing cap 24 an inner hollowed opening 17*a* axially (x) having plurality of internal surface threads 22. Front closing cap 23 being solid at the inward end having plurality of external threads 18 attached to or release from refill handle 12*a* end opening having plurality of internal surface threads 22 integrating via circular rotating front closing cap 23 or refill handle 12*a* until securely joined. The opposite end of refill handle 12*a* plurality of external threads 18 attached to or release from rear closing cap 24 inner hollowed opening 17*a* having plurality of internal surface threads 22 integrating via circular rotating refill handle 12*a* or rear closing cap 24 until securely joined. Disassembling of components are the reversed procedure of the integration of components described therein.

Figure 9:
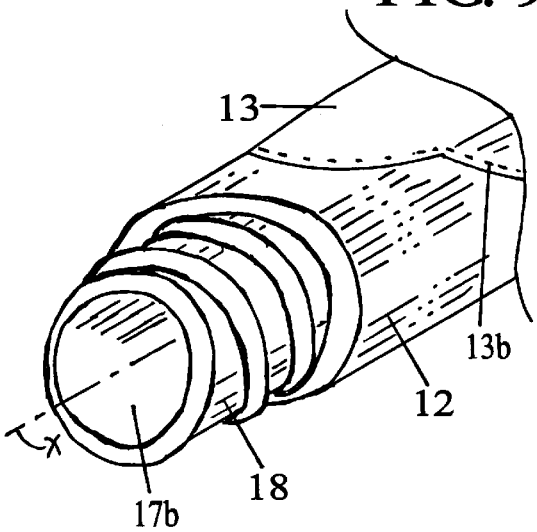
FIG. 9 is an enlarged partial perspective sectional view showing a cylindrical open center axially having plurality of external threads at the end of the fill handle.

FIG. 9 illustrates an enlarged perspective sectional view of fill handle 12 showing the end having plurality of external threads 18, the opening of the bore 17*b* axially (x) for dispensing toothpaste (not shown). The soft elastical non-porous membrane 13 covering the open depressed section 13*b* lengthwise thereon fill handle 12.

Figure 10:
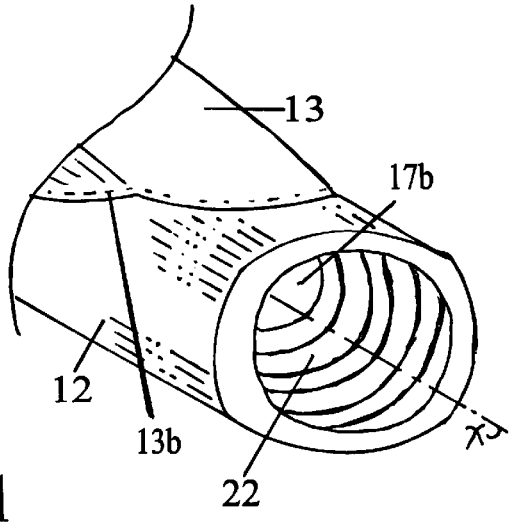
FIG. 10 is an enlarged partial perspective sectional view showing a cylindrical open center axially having plurality of internal surface threads at the end of the fill handle .

FIG. 10 illustrates an enlarged perspective sectional view of fill handle 12 end showing the open bore 17*b* having plurality of internal surface threads 22 axially (x). The soft elastical non-porous membrane 13 covering the open depressed section 13*b* thereon fill handle 12.

Figure 11:
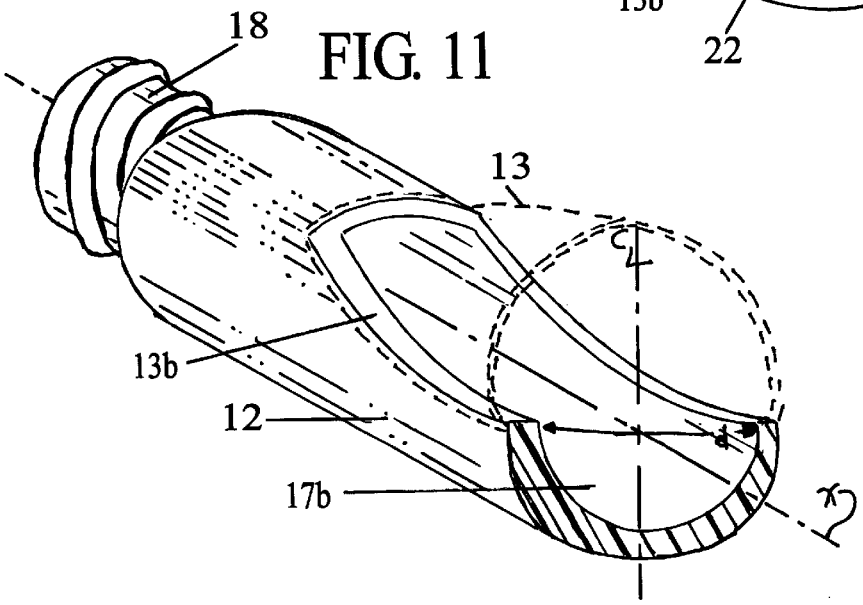
FIG. 11 is an enlarged partial perspective cross sectional view of the end having plurality of external threads, showing the open cavity having concave sides extending from the fill handle front to the intersecting of the latitude center line, longitude axial, and longitude diameter line of the cylindrical open center of the fill handle.

FIG. 11 illustrates an enlarged perspective cross-section sectional view of fill handle 12 end having an open bore 17*b* axially (x) within and throughout for storage of toothpaste (not shown) having plurality of external threads 18. The soft elastical non-porous membrane 13 (not shown) to show clarity of the open depressed section 13*b*. The open depressed section 13*b* therein fill handle 12 extending lengthwise, intersecting at center line (CL), the axis (x) and diameter line (d).

Figure 12:
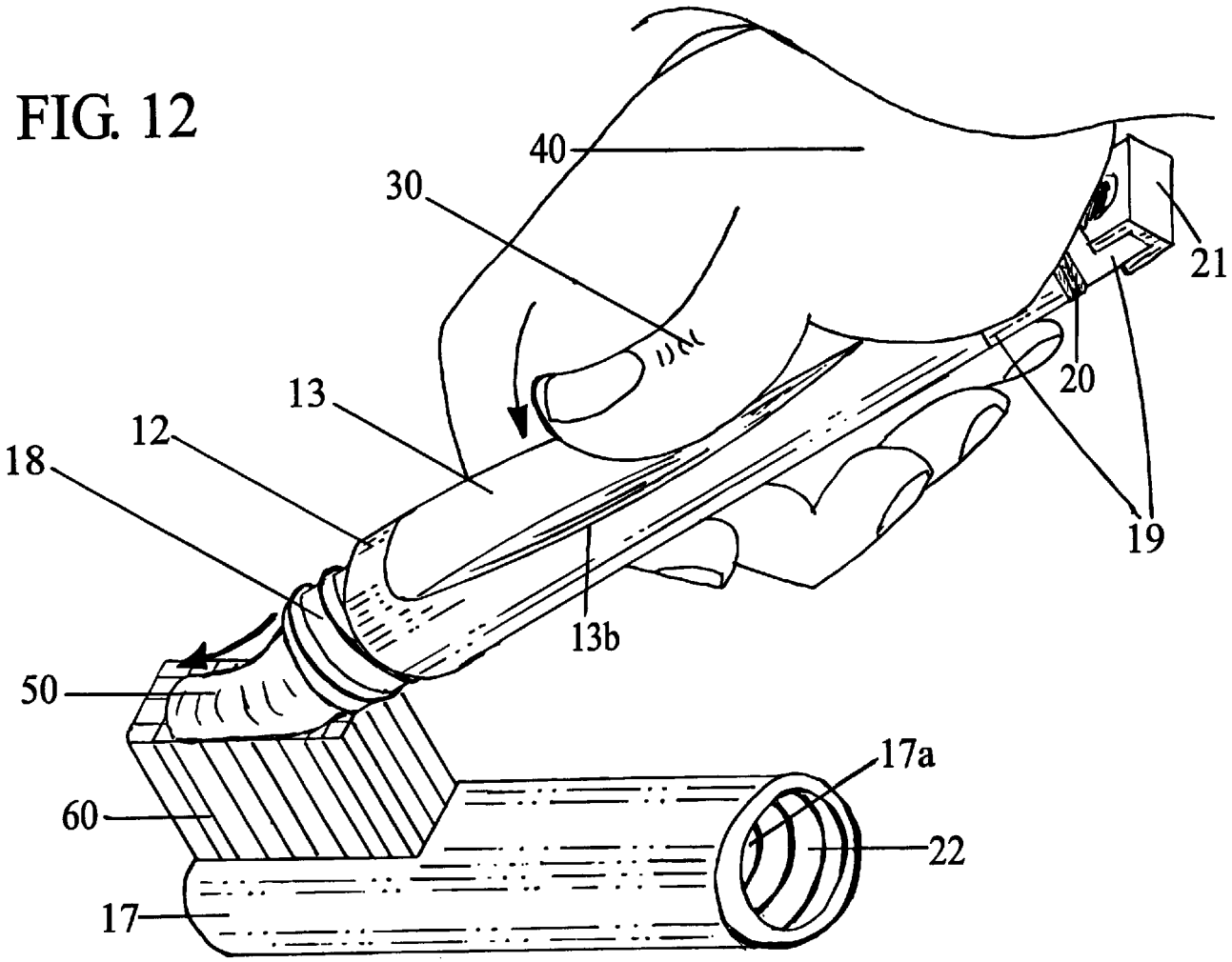
FIG. 12 is a perspective view showing a demonstration of the present invention with the integrated components of the present invention by an user's hand dispensing toothpaste.

FIG. 12 illustrates a demonstration of the present invention's preferred embodiments. Neck 17 inner hollowed opening 17*a* having plurality of internal surface threads 22 is disassembled from fill handle 12. Fill handle 12 having distal ends, at one end plurality of external threads 18, at the opposite end an end plug 19 integrated securely to fill handle 12 having a floss cutter 21 and dental floss 20. The user's hand 40 grips fill handle 12. By a single actuation on the soft elastical non-porous membrane 13 by the user's thumb 30 over the soft elastical non-porous membrane 13 covering the open depressed section 13*b* on fill handle 12. Therein would cause pressure within and throughout fill handle 12 filled with toothpaste 50. To release pressure within the fill handle 12, toothpaste 50 would be dispensed from fill handle 12 onto tufts 60.

Directing attention to the unique and novel characteristics of the preferred embodiments of the specific individual components. Referring to FIGS. 3, 4, 5, 6, 7, 8 the relationship between fill handle 12 and refill handle 12*a* is that these components are exact duplication of one another. Neck 17 end having an inner hollowed opening 17*a* complementarity integrates with the plurality of external threads 18 either of fill handle 12 or refill handle 12*a*. The end plug 19 end having plurality of external threads 18 complementarity integrates with the plurality of internal surface threads 22 either of fill handle 12 or refill handle 12*a*. Front closing cap 23 end having plurality of external threads 18 complementarity integrates with the plurality of internal surface threads 22 of either fill handle 12 or refill handle 12*a*. Rear closing cap 24 end having an inner hollowed opening 17*a*, within inner hollowed opening 17*a* having internal surface threads 22 complementarity integrates with the plurality of external threads 18 of either fill handle 12 or refill handle 12*a*. Furthermore, an available soft commercial tube of toothpaste 16 having plurality of external threads shown in FIG. 2 complementarity integrates with the internal surface threads 18 of either fill handle 12 or refill handle 12*a* for the purpose of refilling process.

In the drawings and specification, there has been set forth illustrative embodiments for the present invention and although specific terms are employed, these are used in a generic sense only and not for purpose of limitation. The preferred embodiments ends need only be complementarity to each other. The preferred embodiments described herein detail for illustrative purposes is subject to many variations and structure and design. It is understood that the details herein are interpreted as illustrative and not in a limiting sense. It is understood that various omissions, substitutions of equivalents are contemplated as circumstance may suggest or render expedient, but is intended to cover the application or implementation without departing from the spirit or scope of the claims of the present invention.

We claim:

1. A fill, refill disposable toothbrush package, said package comprising;

A fill handle having distal ends; said fill handle having a bore within and throughout for storage of toothpaste; thereon said fill handle having an open depressed section lengthwise; securely attached to said fill handle an elastical non-porous membrane covering said open depressed section; said fill handle having at one end attachable releasable means; at the opposite end attachable releasable means;

a refill handle having distal ends; said refill handle having a bore within and throughout for storage of toothpaste; said refill handle having an open depressed section lengthwise; securely attached to said refill handle an elastical non-porous membrane covering said open depressed section lengthwise; said refill handle having at one end attachable releasable means; at the opposite end attachable releasable means;

a solid neck having distal ends; tufts attached at one end of said solid neck; at the opposite end of said neck an inner hollowed opening having attachable releasable means complementarity to at least one of said fill handle attachable releasable means; and to at least one of said refill handle attachable releasable means;

a solid end plug having distal ends; said end plug having an annular groove; wound around said annular groove dental floss; one end of said solid end plug having attachable releasable means complementarity to at least one of said fill handle attachable releasable mean and to at one of said refill handle attachable releasable means; at the opposite end of said end plug a floss cutter; said floss cutter securely attached within an indented groove of said end plug;

a front closing cap having distal ends; one end of said front closing cap having attachable releasable means attachable to at least one of said fill handle complementarity attachable releasable means and at least one of said refill handle complementarity attachable releasable means;

a rear closing cap having distal ends; one end of said rear closing cap having attachable releasable means attachable to one end of said fill handle complementarity attachable releasable means and to at least one of said refill handle complementarity attachable releasable means;

wherein said fill handle and said refill handle are connectable to a toothpaste tube by connecting the toothpaste tube to one of said attachable releasable means thereon such that said fill handle and said refill handle can be refilled with toothpaste from the toothpaste tube.

* * * * *